US010947662B2

(12) United States Patent
Akin

(10) Patent No.: US 10,947,662 B2
(45) Date of Patent: Mar. 16, 2021

(54) GLOVE SHAPING AND PROTECTING DEVICE

(71) Applicant: Re-Peat Sports, LLC, Pleasant Hill, MO (US)

(72) Inventor: Tim Akin, Pleasant Hill, MO (US)

(73) Assignee: RE-PEAT SPORTS, LLC, Pleasant Hill, MO (US)

( * ) Notice: Subject to any disclaimer, the term of this patent is extended or adjusted under 35 U.S.C. 154(b) by 647 days.

(21) Appl. No.: 15/666,241

(22) Filed: Aug. 1, 2017

(65) Prior Publication Data

US 2018/0028897 A1 Feb. 1, 2018

Related U.S. Application Data

(60) Provisional application No. 62/369,635, filed on Aug. 1, 2016.

(51) Int. Cl.
*D06F 59/04* (2006.01)
*A63B 71/14* (2006.01)

(52) U.S. Cl.
CPC ..... *D06F 59/04* (2013.01); *A63B 71/143* (2013.01)

(58) Field of Classification Search
None
See application file for complete search history.

(56) References Cited

U.S. PATENT DOCUMENTS 4,418,849 A * 12/1983 Santa ..... A63B 71/143 2/19
4,637,610 A * 1/1987 Carr ..... A63B 69/0002 2/19
5,868,368 A * 2/1999 MacDonald ..... A63B 71/0036 248/176.3
8,651,342 B1 2/2014 Sexton
D734,028 S * 7/2015 Noble ..... D3/254
D759,967 S * 6/2016 Schug ..... D3/254

* cited by examiner

*Primary Examiner* — Clinton T Ostrup
*Assistant Examiner* — Andrew Wayne Sutton
(74) *Attorney, Agent, or Firm* — Husch Blackwell

(57) ABSTRACT

A forming and shaping device for shaping a baseball or softball glove into a desired shape is provided. The device can include an exterior wall shaped to generally conform to the exterior web of the glove, an interior wall shaped to generally conform to the interior web of the glove, and a void defined between the exterior and interior walls configured to receive and hold the web of the glove in the desired shape. The device can include an opening defined between the interior and exterior walls to allow the glove to be inserted into the void. The device can have an arcuate shape configured to form the glove web into the desired shape. The interior wall can include upper and lower portions configured to form a pocket into the glove. The device can be constructed into a rigid shape in order to protect the glove and prevent deformation.

20 Claims, 9 Drawing Sheets

GLOVE SHAPING AND PROTECTING DEVICE

CROSS-REFERENCE TO RELATED APPLICATIONS

This application claims priority to U.S. Provisional Patent Application Ser. No. 62/369,635, filed on Aug. 1, 2016, to Tim Akin, entitled "Glove Shaping and Protecting Device," the entire disclosure of which is incorporated herein by reference.

FIELD OF THE INVENTION

The present invention is directed generally to devices and methods for forming, shaping and/or protecting the desired shape of a shapeable object, and in particular, to devices and methods for forming, shaping and/or protecting baseball gloves and softball gloves.

BACKGROUND OF THE INVENTION

Several attempts have been made in the prior art to create a device or system for effectively shaping and forming a shapeable object, and in particular, a baseball or softball glove or the like, and for effectively protecting the glove during storage. One such example is disclosed in U.S. Pat. No. 4,418,849 to Santa, which discloses an outer clamshell plastic body that can be placed around the exterior of a glove and clamped to hold the glove in a closed configuration and in a protected position. Another example is the WebGem Glove Care System which includes a form that is inserted into the opening and pocket of the glove and then the glove is placed in a neoprene bag that is cinched tight. While each of the aforementioned examples helps shape and form a baseball or softball glove, these devices can fail to provide sufficient shaping and can fail to properly shape and form a glove as desired by many baseball and softball players. For example, these known devices and systems for shaping and protecting gloves can cause a glove to be formed to an improper shape not desired by the user and can fail to adequately protect a glove during storage.

Accordingly, a need exists for a device that can properly and effectively shape and form a baseball or softball glove into a desired shape. A need also exists for a glove forming device that is easy to use and can properly retain, mold and protect a glove without the required use of straps and added securement means.

SUMMARY OF THE INVENTION

The present invention is directed to a glove forming device configured for forming and shaping a baseball or softball glove into a desired shape. According to one embodiment, the glove forming device can include an exterior wall generally conforming to an exterior of the glove, an interior wall generally conforming to an interior of the glove, a top wall connecting the interior and exterior walls together, and a void defined between the exterior and interior walls configured to receive and hold the glove in the desired shape. The device can be configured to receive the glove within the void and the exterior and interior walls can be shaped and configured to hold and maintain the glove in the desired shape while the glove is located in the device. The device can include an opening defined between terminal edges of the exterior and interior walls to provide access to the void to insert the glove into the device. According to one embodiment, the opening can include a cutout into a lower portion of the exterior wall to accommodate the hand receiving portion of the glove.

According to one embodiment, the interior sidewall can include an upper region and a lower region that curves inward with respect to the upper region. The curvature of the interior sidewall can create a pocket forming region in the device that can form a pocket along the interior sidewall of the glove. The exterior sidewall can similarly include an upper region and a lower region that curves inward with respect to the upper region in order to allow the void defined between the interior and exterior walls to generally conform to the overall shape of the glove.

According to one embodiment, the width of the void can be greater at the lower regions of the device as compared to the upper regions of the device. This configuration can allow the interior and exterior walls of the device to shape the web of the glove into the desired shape and allow the glove to be easily inserted into the device.

According to one embodiment, the interior and exterior walls can have a generally arcuate horizontal cross section defining the device with a generally semi-circular shape that generally conforms to the shape of the glove web.

The device can be constructed from any suitable type of material, including a plastic or polymer-based material. According to one embodiment, the device can be constructed into a rigid shape that can prevent the glove from deforming when it is inserted into the void of the device and can provide protection for the glove.

The present invention is also directed to a forming device for molding a shapeable object. The device can include a main body having a first wall, a second wall spaced apart from the first wall, a top wall extending between and connecting an upper edge of the first wall and an upper edge of the second wall, a void defined between the first wall and the second wall, and an opening defined into the main body and configured to provide access to the void. The main body can be configured to mold a shapeable object inserted in the void into a desired shape. According to one embodiment, the device can be constructed from a single blank of material and formed into a rigid shape.

Other aspects and advantages of the present invention will be apparent from the following detailed description of the preferred embodiments of the accompanying drawing figures.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
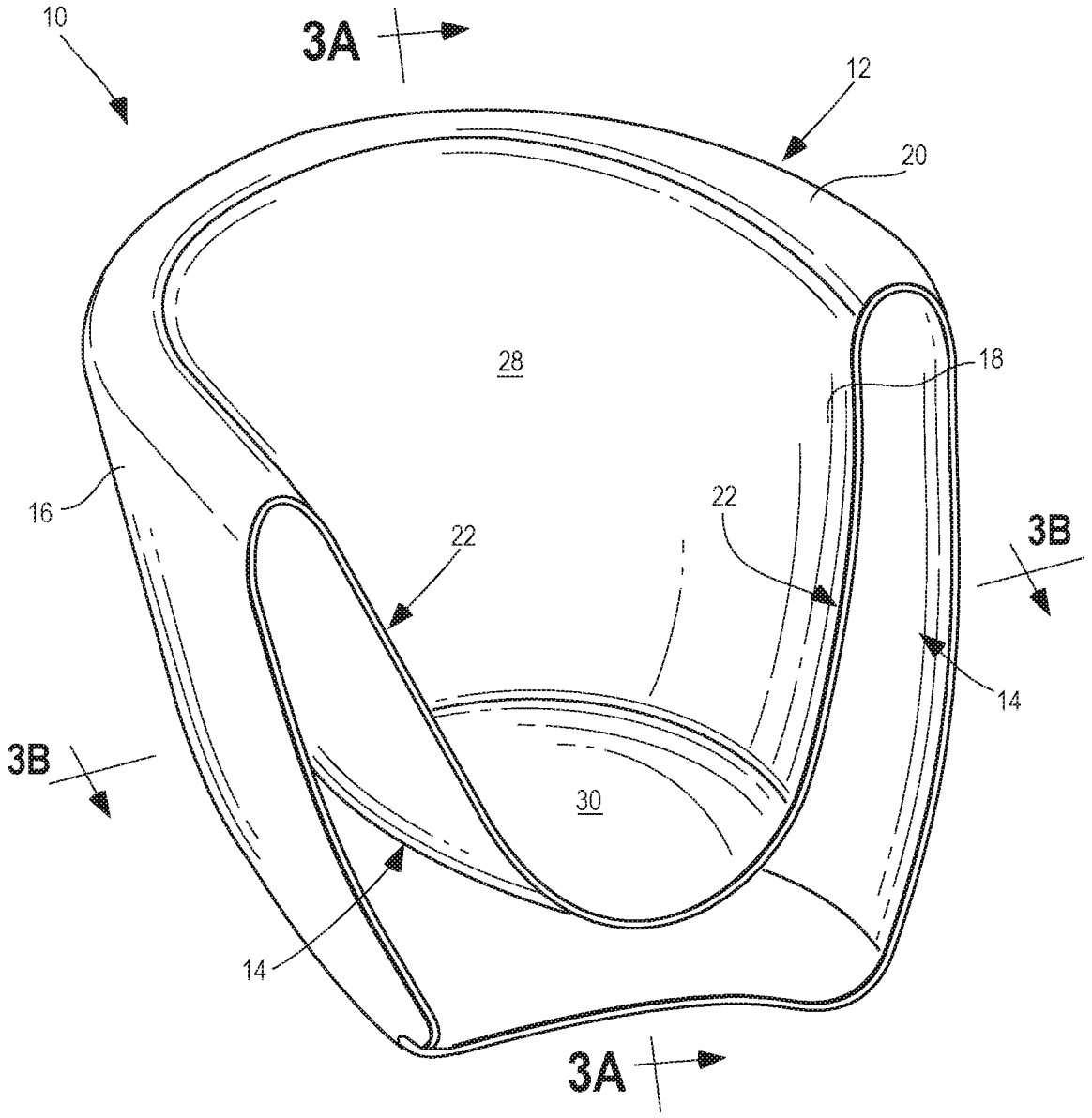
FIG. 1 is a perspective view of a glove shaping device in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Figure 9:
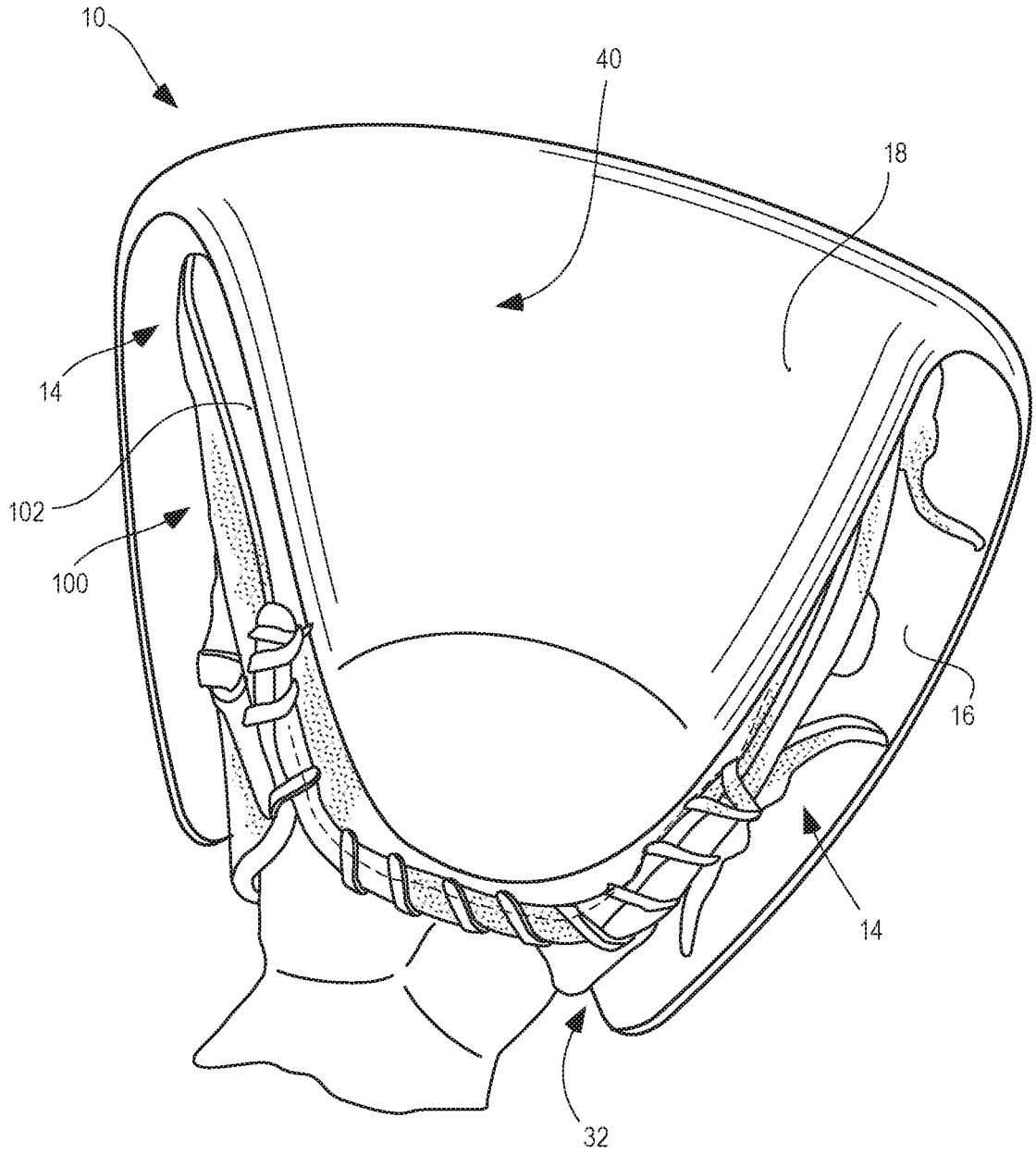
FIG. 9 is a perspective view of a glove shaping device and a glove in accordance with one embodiment of the present invention.

The present invention is directed generally to a forming and shaping device 10 configured to form, mold, shape and/or maintain the shape of any suitable shapeable object 100. According to one embodiment of the present invention, the device 10 is configured as a glove shaping and protecting device 10 as illustrated in the several figures. Device 10 can be used in conjunction with a glove 100 (as shown in FIG. 9) in order to form and shape glove 100 as described in greater detail below. Device 10 can also be used as a protection device for the shapeable object or glove 100 by protecting it against damage and deformation during transport and storage.

Figure 2A:
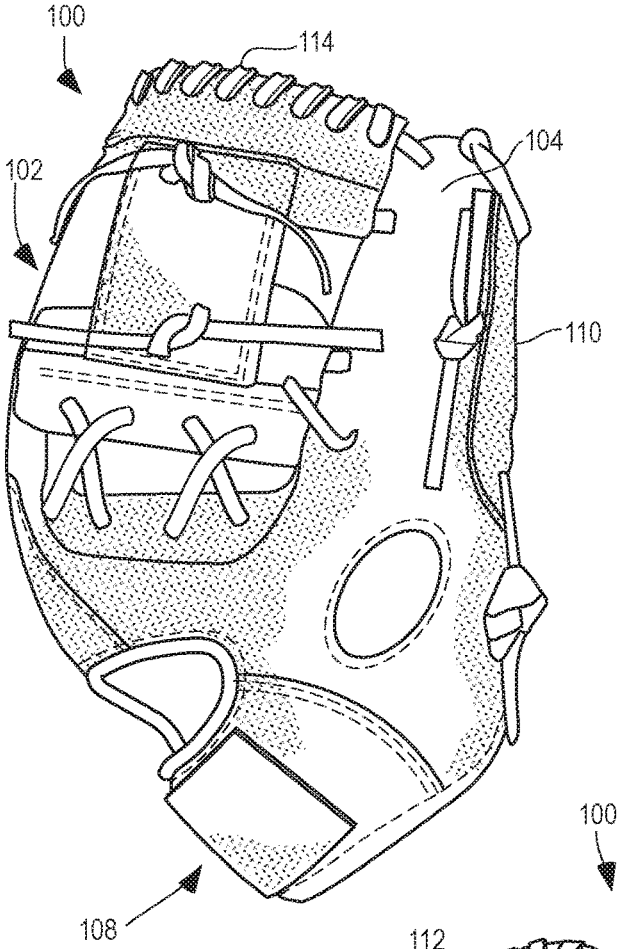
FIG. 2A is a side perspective view of a typical glove in accordance with one embodiment of the present invention.
Figure 2B:
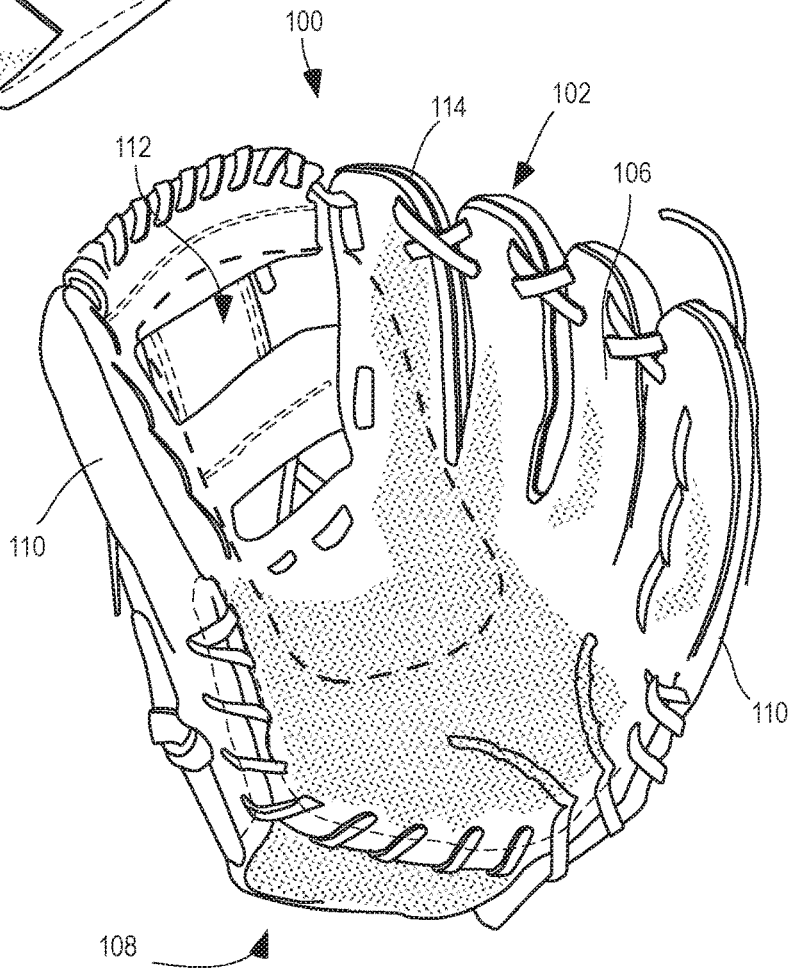
FIG. 2B is a perspective view of the glove of FIG. 2A, illustrating an interior of the glove.

As shown in FIGS. 2A and 2B, a typical glove 100 can include a webbing 102 having an exterior sidewall 104, an interior sidewall 106 and a hand receiving region 108. Glove 100 can further include end portions 110 on each side of glove 100 and a top wall portion 114 along the top of webbing 102. In its opened position, glove 100 can have a generally curved-wall profile created by the semi-circle shaping of webbing 102. This curved shaping of webbing 102 can define a pocket region 112 within the interior of glove 100. Glove 100 can comprise any one of the various types of gloves common to baseball and/or softball, such as an infielder's glove, an outfielder's glove, a first-base glove or a catcher's glove. In addition, while glove 100 as shown in FIGS. 2A and 2B is a right-handed glove (i.e., adapted to fit on the user's left hand), glove 100 can alternatively be a left-handed glove (i.e., adapted to fit on the user's right hand) in many suitable embodiments.

Figure 3A:
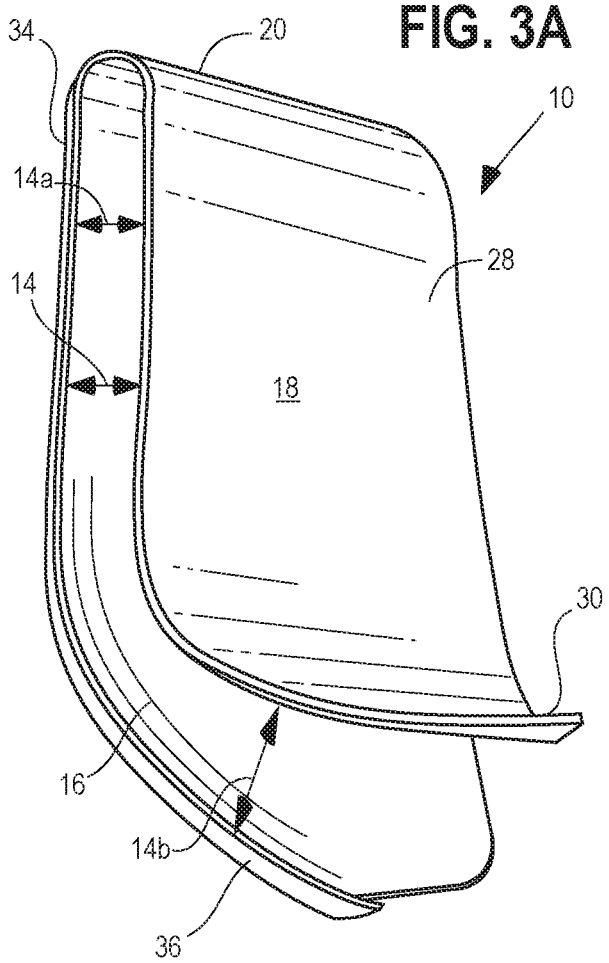
FIG. 3A is a side section view of the device of FIG. 1 taken along line 3A.
Figure 3B:
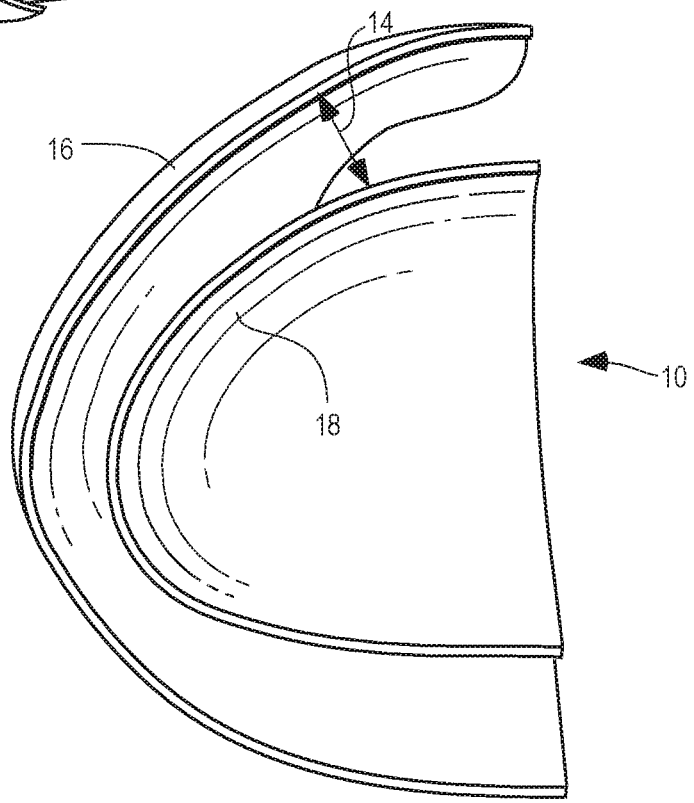
FIG. 3B is a top section view of the device of FIG. 1 taken along line 3B.

As illustrated in the several figures, device 10 can be configured for positioning glove 100 in a secure and optimal molding/forming position. Device 10 can include a main body or shell portion 12 configured and shaped for receiving, surrounding and holding glove 100 in a proper formed position (see FIG. 9). Device 10 can also include a strap or similar means (not shown) that can be used for easier transport of device 10 and/or assisting device 10 in holding glove 100 in position in certain embodiments of the present invention. Main body 12 can have a slot or void 14 defined between a first (exterior) wall 16 and a second (interior) wall 18 that can be configured for holding glove 100. Slot or void 14 may also be referred to as the glove receiving region 14 within device 10. As best shown in FIGS. 1, 3A and 3B, first and second walls 16 and 18 are spaced apart from one another to generally accommodate glove 100 within void 14 of device 10. Main body 12 can be enclosed along the top of device 10 by a shoulder or top wall 20 extending between first wall 16 and second wall 18 and forming an upper boundary of slot or void 14.

As best shown in FIG. 1, main body 12 can have a rounded or curved shape that generally conforms to the typical shape of web portion 102 of glove 100. As best shown in FIGS. 1 and 3B, according to one embodiment, first and second walls 16 and 18 can extend laterally in an arcuate path to create a semi-circular upper perimeter of main body 12. Main body 12 can further include ends 22 at each lateral end of the arcuate perimeter of main body 12 as best shown in FIG. 1. Ends 22 can be defined by terminating edges 24 and 26 of first and second walls 16 and 18, respectively, which can extend in the longitudinal direction of first and second walls 16 and 18. In order to properly form and protect glove 100, ends 22 can be configured for extending beyond glove ends 110 when glove 100 is place within device 10. By extending beyond glove ends 110, ends 22 of device 10 can allow device 10 to form and shape glove ends 110 within void 14 and prevent undesired curling or deformation of glove ends 110. In certain embodiments of the present invention, ends 22 can be open and allow access to void 14 as best shown in FIG. 1. In alternative embodiments, ends 22 can be fully or partially enclosed so that terminating edges 24 and 26 of first and second walls 16 and 18, respectively, intersect to prevent direct access to void 14 along all or part of ends 22.

Main body 12 of device 10 can be formed from any suitable rigid or semi-rigid material, including, but not limited to, any suitable plastic or polymer-based materials. According to one embodiment of the present invention, main body 12 can be found through a blow molding process where a thermoplastic or other suitable material is expanded inside a mold. Any suitable type of blow molding process can be used to form main body 12 with void 14 defined therein.

According to another embodiment of the present invention, main body 12 can be formed from a single blank of material that is placed into a flexible or moldable state (such as by applying heat to one or more portions of the blank) and then molded into main body 12. In such an embodiment, the blank of material can be folded into first and second walls, 16 and 18, such that they are kept spatially apart in order to form void 14 between the walls 16 and 18. The folded region of the blank can form the shoulder or top wall 20 of device 10. The molding and forming of main body 12 can be accomplished by means of forming blank or die, where the blank of material is heated and then placed around the forming blank in order to form device 10 into the desired shape and configuration.

According to another embodiment of the present invention, device 10 can be formed using an injection molding process (or other suitable manufacturing process). According to one embodiment of the present invention, device 10 can be formed using two or more blanks that are injection molded and then subsequently joined together. According to one embodiment of the present invention, first wall 16 can be formed from one blank and second wall 18 can be formed from another blank, and then the first and second wall sections 16 and 18 are joined together (such as along top wall 20) in order to form device 10 into a single component. Several alternative means and methods for forming device 10 into a particular shape, including the use of two or more pieces or blanks to form main body 12, or from a particular material can also be used in various embodiments of the present invention.

Turning to FIG. 1, device 10 can be seen in an upright position with second (interior) wall 18 facing forward, according to one embodiment of the present invention. As shown, device 10 can have a generally curved shape with a generally semicircle-shaped horizontal cross-section that can roughly conform to the general curved shape of a typical glove 100 (shown in FIGS. 2A and 2B). Interior wall 18 can be seen as having an upper region 28 that is generally vertically orientated to conform to the interior sidewall 106 of glove 100. Interior wall 18 can also include a lower region 30 that is curved inward and more horizontally sloped to also conform to the shape of interior sidewall 106 of glove 100.

As best shown in FIG. 1, exterior wall 16 can be wrapped around interior wall 18 in a spaced-apart configuration defined by the width of void 14. FIG. 1 further illustrates the general shape of exterior and interior walls 16 and 18, respectively, where the upper region 28 of second wall 18 extends longitudinally at an angle slightly greater than first wall 14 (along the upper region 34 of first wall 14 as shown in FIG. 3A) so that void 14 can have a gradually increasing width from the top of main body 12 to the bottom of main body 12. FIG. 3A best illustrates the increasing width of void 14 in the longitudinal direction of main body 12 between first and second walls 16 and 18. As shown, an upper void region 14*a* can have a more narrow width between upper region 34 of first wall 16 and upper region 28 of second wall 18, while a lower void region 14*b* can have an increased, wider width between lower region 36 of first wall 16 and lower region 30 of second wall 18 relative to region 14*a*. This configuration can assist in allowing glove 100 to be inserted into device 10 and can allow device 10 to accommodate the varying width of webbing 102 of glove 100. This configuration can also allow device 10 to accommodate the hand receiving portion 108 of glove 100 within void 14.

FIGS. 3A and 3B illustrate vertical and horizontal cross-sections of device 10 as shown in FIG. 1 in order to more fully show the orientation and relationship of walls 16 and 18 and void 14 according to one embodiment of the present invention. As shown in FIGS. 1, 3A and 3B, first, exterior wall 16 can extend longitudinally from top wall 20 and include an upper region 34 and a lower region 36. As best shown in FIGS. 3A and 3B, upper region 34 of exterior wall 16 can extend generally vertically (in the longitudinal direction) with respect to lower region 36, which can have a general arcuate shape and extend inward relative to upper region 34 of exterior wall 16. This shape of exterior wall 16 (in the longitudinal direction) can be configured to generally conform to the shape of exterior sidewall 104 of webbing 102 of glove 100. Similarly, as best shown in FIGS. 3A and 3B, upper region 28 of second, interior wall 18 can extend generally vertically (in the longitudinal direction) with respect to lower region 30, which can be angled inward relative to upper region 28 to allow interior wall 18 to generally conform to the shape of interior sidewall 106 of webbing 102 of glove 100.

Figure 4:
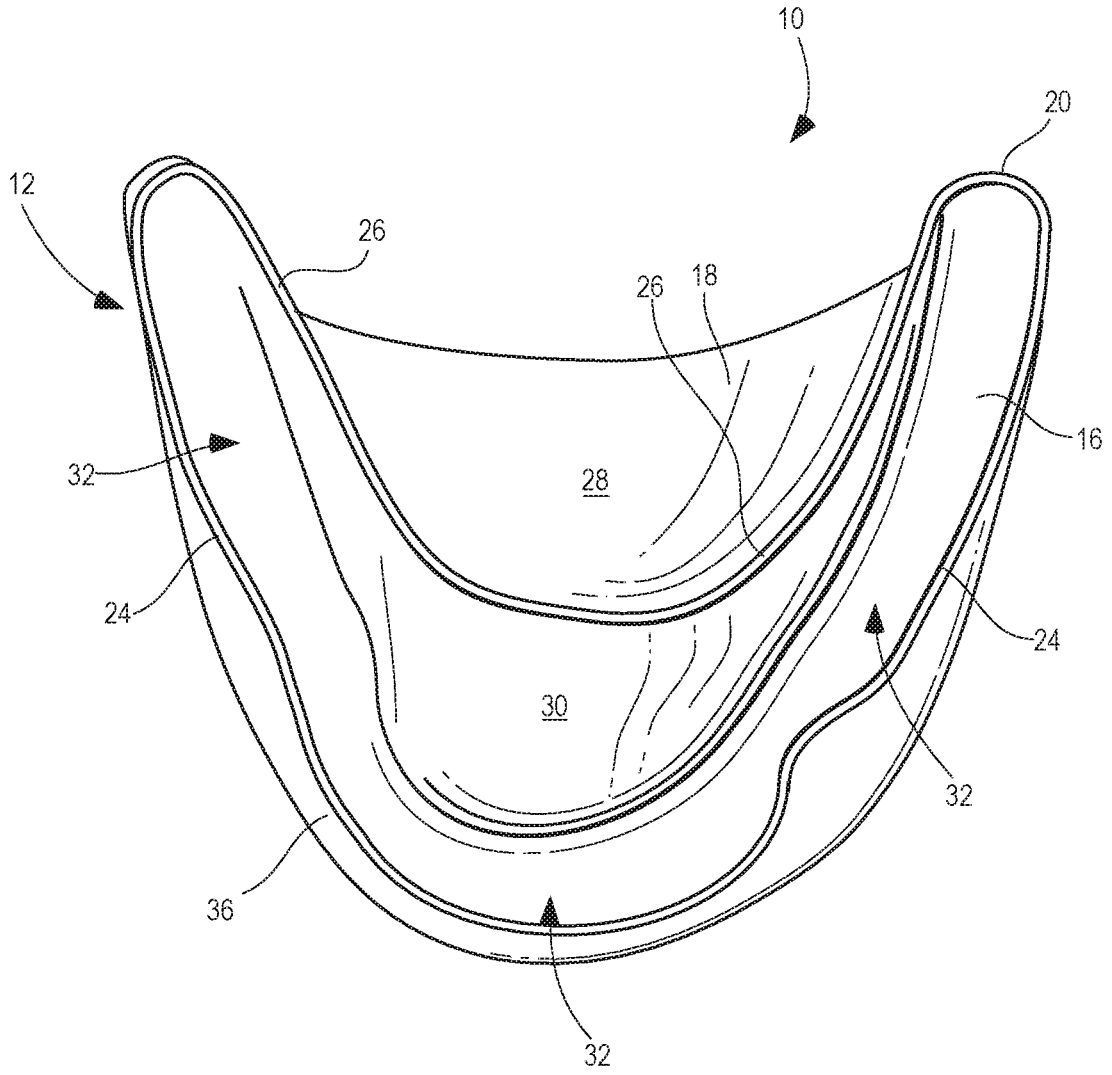
FIG. 4 is a bottom perspective view of a glove shaping device in accordance with one embodiment of the present invention.

FIG. 4 illustrates a bottom perspective view of device 10 and illustrates an opening 32 defined between lower region 30 of interior wall 18 and lower region 36 of exterior wall 16. Opening 32 can also be continuous with and extend along the height of ends 22 in certain embodiments. As shown in FIG. 4, ends 22 of device 10, which are defined by the side edges 24 and 26 of first and second walls 16 and 18, respectively, can be unenclosed so that opening 32 can extend throughout all or part of ends 22. In other embodiments, opening 32 can terminate at a lower edge of ends 22 and ends 22 can be enclosed similar to shoulder or top wall 20. Opening 32 can further be configured to facilitate inserting glove 100 into device 10 by increasing the overall receiving area for which glove 100 can be inserted into device 10 in certain embodiments of the present invention.

Figure 5:
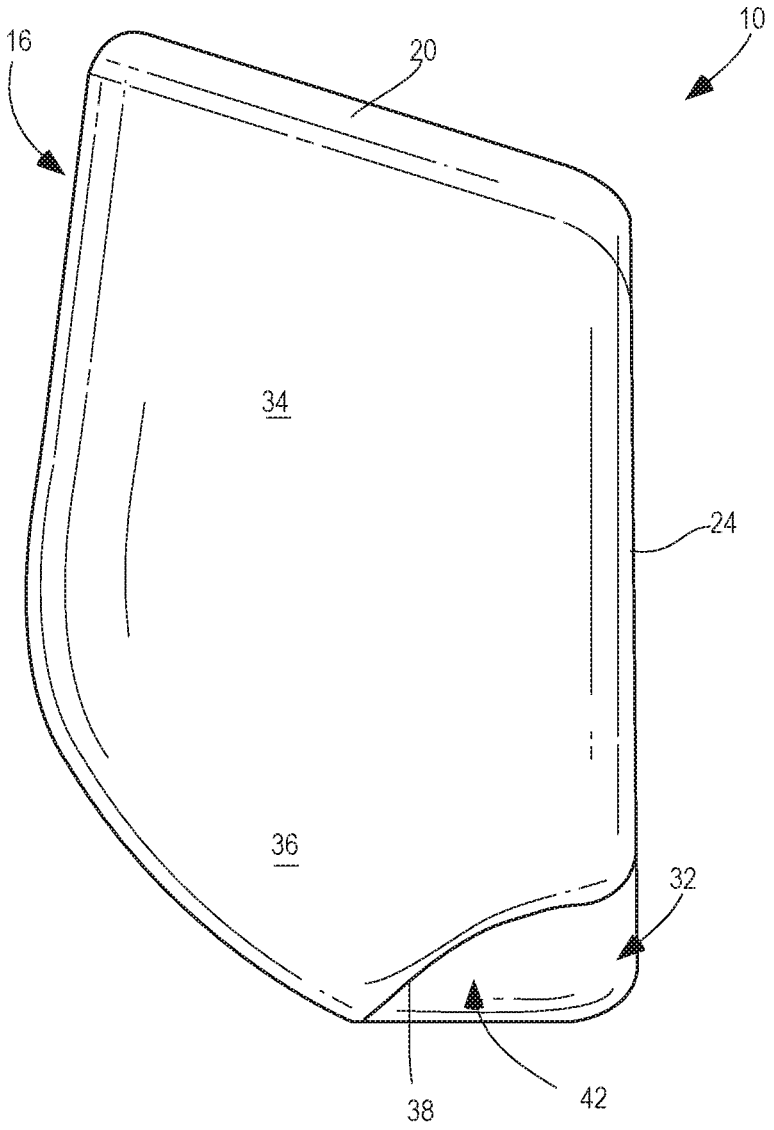
FIG. 5 is a side perspective view of a glove shaping device in accordance with one embodiment of the present invention.
Figure 6:
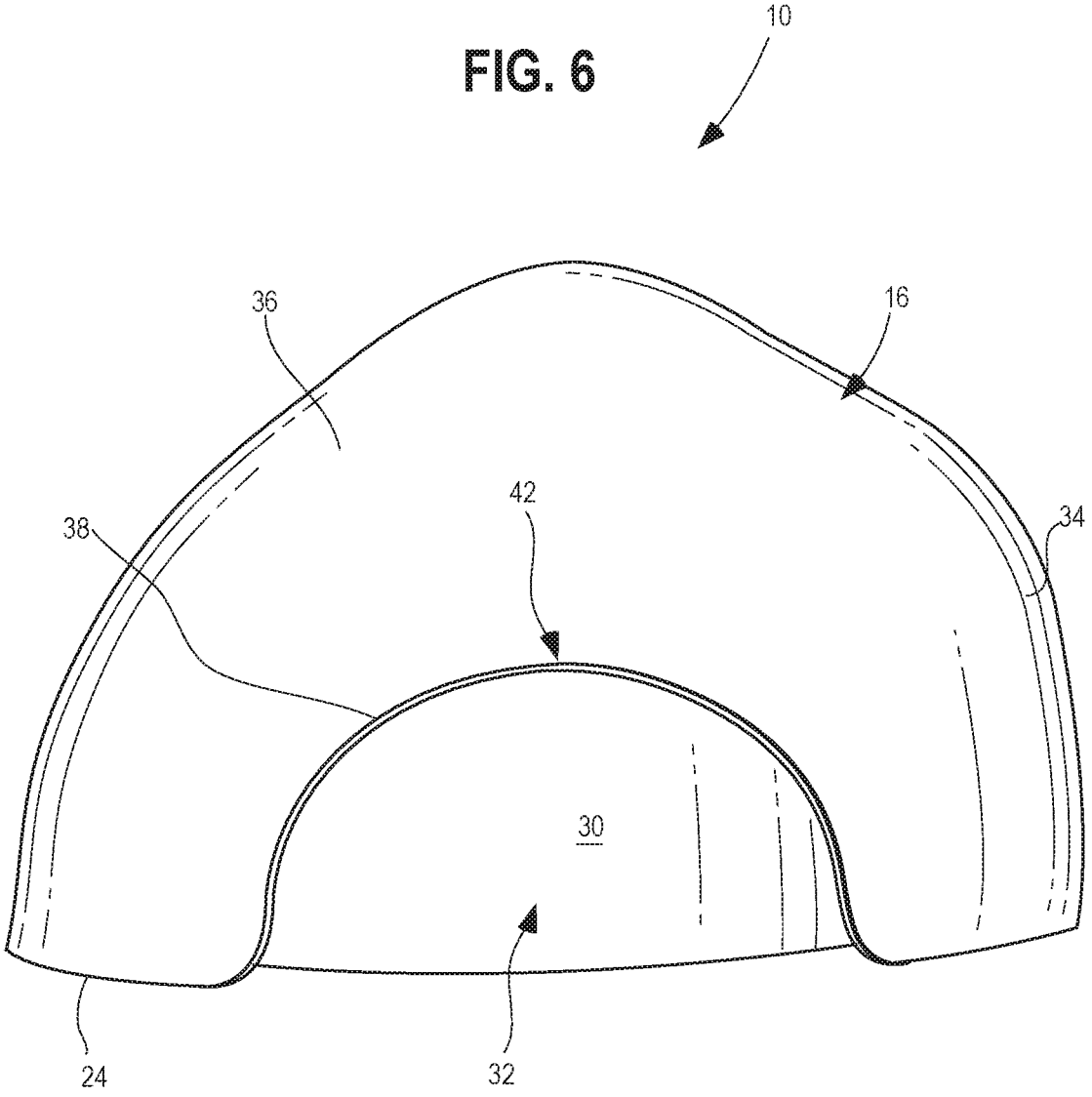
FIG. 6 is a bottom perspective view of a glove shaping device in accordance with one embodiment of the present invention.
Figure 7:
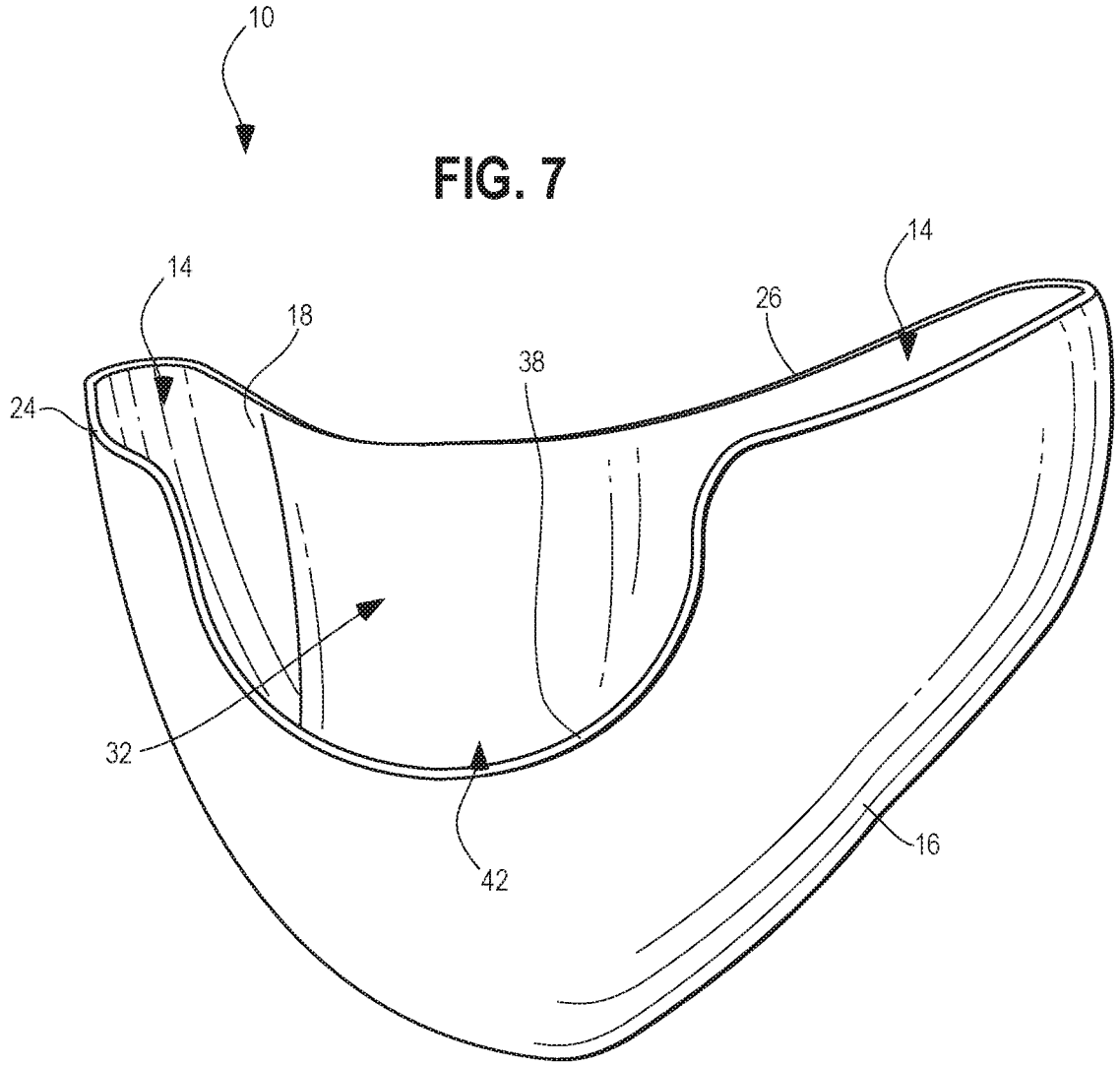
FIG. 7 is a bottom perspective view of a glove shaping device in accordance with one embodiment of the present invention.

FIG. 5 illustrates a side view of device 10, according to one embodiment of the present invention, showing first (exterior) wall 16. As shown in FIG. 5, the overall shape and curvature of first wall 16 can be configured so as to generally conform to the overall shape and curvature of exterior sidewall 104 of glove 100 as shown in FIG. 2A. As further shown in FIG. 5, first wall 16 can include upper region 34 that can be generally vertically orientated and lower region 36 that can be angled and/or curved inward toward second wall 16 relative to upper region 34. Lower region 36 can include such an inwardly angled-shape so as to conform device 10 to hand receiving region 108 of glove 100. FIG. 5 also illustrates opening 32 that can be provided along the lower part of device 10 (and can extend upward along ends 22 of main boy 12 in certain embodiments). As shown, a lower edge 38 of exterior wall 16 can extend from side edge 24 and inward into lower region 36 to form a cutout portion 42 of opening 32. Cutout 42 can form the entirety of opening 32 (where ends 22 of main body 12 between first and second walls 16 and 18, respectively, are closed) in certain embodiments of the present invention. Cutout 42 can also provide an increased width section of opening 32 in order to facilitate the insertion of glove 100 into device 10. FIGS. 6 and 7 further illustrate void 14 and opening 32 of device 10 according to one embodiment of the present invention. As shown, opening 32 can extend inward into lower region 36 of exterior sidewall 16 to form cutout portion 42. Opening 32 and cutout portion 42 can also be continuous with void 14 on each end 22 of device 10 in certain embodiments as shown in FIGS. 6 and 7.

Figure 8:
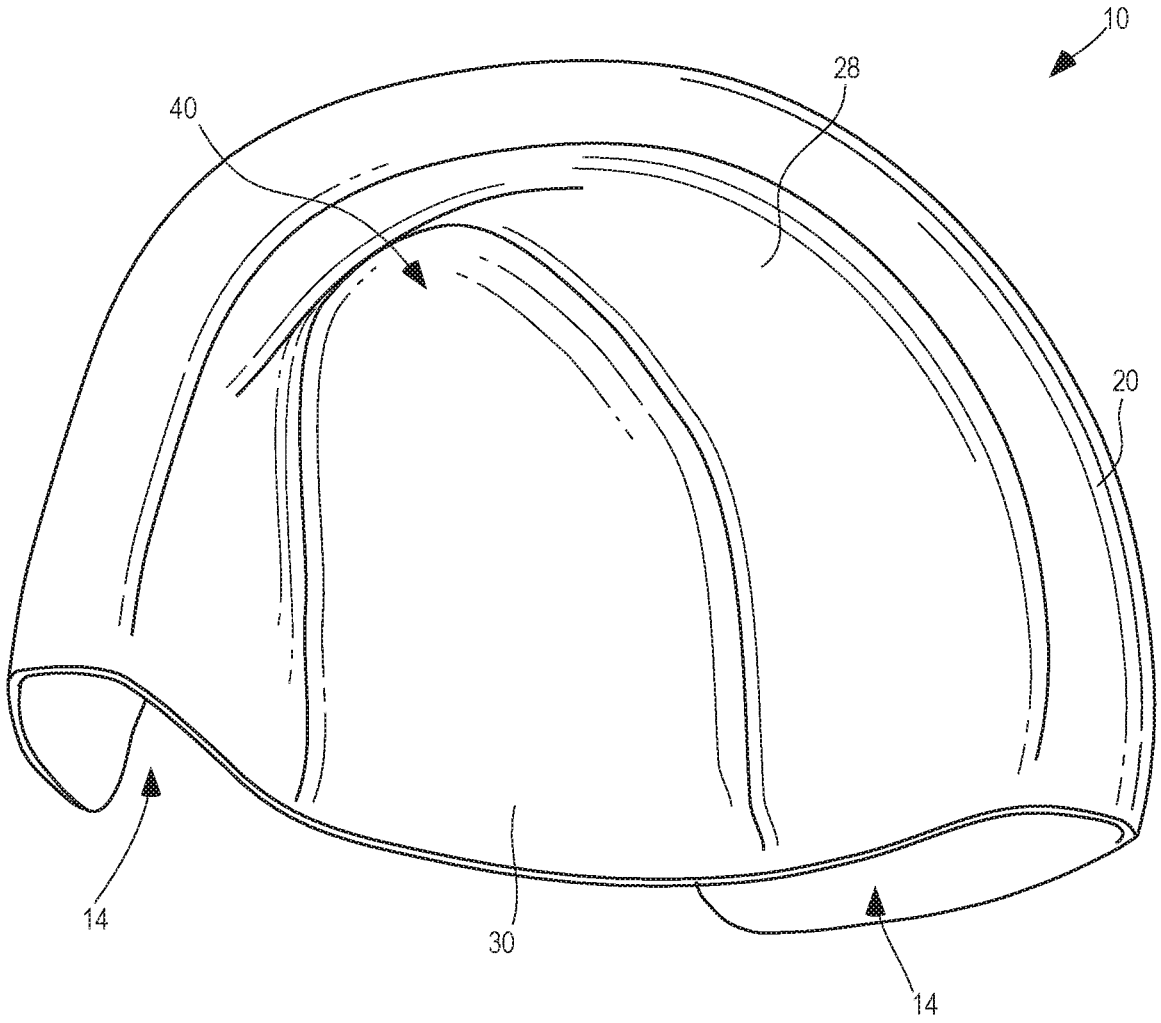
FIG. 8 is a top perspective view of a glove shaping device in accordance with one embodiment of the present invention.

FIG. 8 illustrates a top view of device 10 showing a pocket forming region 40 defined by second, interior wall 18 according to one embodiment of the present invention. Pocket forming region 40 can be defined by the curved geometries of upper region 28 and lower region 30 of interior wall 18. Pocket forming region 40 can be designed to form upon the interior sidewall 106 the proper geometry in order to create a proper pocket within interior pocket region 112 when glove 100 is within device 10 as described in greater detail below. As shown in FIG. 8, the vertical orientation of the upper region 28 of interior wall 18 transitions in an inward direction at lower region 30 to provide a pocket-shaped geometry of pocket forming region 40. The similar orientation and shape of upper region 34 and lower region 36 of exterior wall 16 provides the void regions 14*a* and 14*b* (shown in FIG. 3A), which force the webbing 102 of glove 100 to conform to void 14 (and the shape of interior and exterior walls 18 and 16, respectively) when inserted into device 10 and press into the interior sidewall 106 of glove 100 the shape of pocket forming region 40.

FIG. 9 illustrates device 10 with glove 100 positioned in void 14 of device 10. Glove 100 can be inserted into device 10 by inserting top edge 114 of glove 10 through opening 32 (and/or cutout 42) of main body 12 and sliding the webbing 102 of glove 100 around lower region 30 of interior wall 18 and through void 14 until top edge 114 is approximately adjacent to or below shoulder/top wall 20. As shown in FIG. 9, the shape of webbing 102 of glove 100 is required to generally conform to the shape of device 10 as it is constrained by exterior and interior walls 16 and 18. The pocket forming region 40 created by the curved-shape of upper region 28 and lower region 30 of interior wall 18 of device 10 defines the optimal pocket region 112 in the interior of glove 10 and the rigid exterior and interior walls 16 and 18 secure the webbing 102 of glove 100 in secure position. Both the exterior and interior walls 16 and 18 of device 10 can apply pressure to the exterior and interior sidewalls 104 and 106 of glove 100 to retain glove 100 within void 14 without added straps or supports. The pressure applied by both walls 16 and 18 further facilitates the proper molding of the webbing 102 of glove 100 by preventing undesired curling or flaring of the webbing 102 present when pressure is only applied to one sidewall 104 or 106 of glove 100.

The ends 22 of device 10 can also retain glove ends 110 in an open position by means of exterior and interior walls 16 and 18, respectively, which prevent glove ends 110 from curling inward around pocket region 112. As a result, device 10 is configured for maintaining glove 100 in a proper forming position when it is inserted within device 10. The shape and curvature of exterior and interior walls 16 and 18 can position glove 100 in a proper opened position and form webbing 102 of glove 100 into a desired shape having an optimal pocket region 112. Finally, ends 110 of glove 100 can be maintained in a straightened or opened position rather than a curled position normally formed from traditional glove shaping devices.

Device 10 can be used to maintain the proper shape of an already formed glove 100, re-shape a previously misshaped glove 100, and/or "break in" an unshaped or unformed glove 100. In order to mold glove 100 into the proper forming position (or "break in" glove 100), glove 100 is inserted through opening 32 (and/or cutout 42) of device 10 into void 14. Glove oils or conditioners can also be applied to glove 100 prior to inserting into device 10. Glove 100 can then be retained within device 10 for an extended period of time. As a result, glove 100 is placed in the proper forming position. When glove 100 is then removed from device 10, it can then maintain the proper forming position during use by the user.

Device 10 can provide significant advantages over other glove forming and shaping devices disclosed in the prior art due to its ease of use, superior forming traits and overall effectiveness. Such other glove forming devices require multiple components, such as a form for inserting into the glove pocket and a wrap or bag for pressing and holding glove 100 around the form. This method of forming glove 100, by applying pressure to the exterior 104 of glove 100 in order to secure glove 100 around the form results in unsatisfactory molding of the webbing 102 of glove 100 because the ends 110 of glove 100 become significantly inwardly turned. Device 10 of the present invention can enable glove 100 to be formed and molded by applying equal pressure to both the exterior 104 and the interior 106 of glove 100. Device 10 can additionally be simpler and easier to use than such other glove forming devices due to its unitary and self-retaining design. The user only has to insert glove 100 through opening 32 (and/or cutout 42) and into void 14. Device 10 then secures and retains glove 100 within void 14 by the pressure applied by interior and exterior walls 16 and 18, respectively. As described above, other glove devices require the user to secure a wrap around glove 100, which requires the user to manually ensure that the glove 100 is placed into a sufficient forming position.

As briefly described above, device 10 can be designed and configured to properly form and mold several different styles of glove 100. Additionally, several different embodiments of device 10 can be uniquely designed and configured for a specific style of glove 100. For example, one embodiment of device 10 can be formed to receive an infielder's glove. In such an embodiment, main body 12 can have an overall height specific to an infielder's glove and can be configured for molding a shallower and wider pocket region 112 as typically desired. In another embodiment, device 10 can be specifically formed and configured to receive an outfielder's glove. In such an embodiment, main body 12 can have an increased height typical of outfielder's gloves and can be configured for molding a deeper pocket typically desired by outfielders. Other embodiments, device 10 can be specifically configured other styles of gloves 100, such as catcher's gloves and first-base gloves. In addition, device 10 can be configured for forming glove 100 in a particular style. For example, in one embodiment, device 10 can be configured for forming or molding glove with a shallow pocket, deep pocket, flared ends, or any other style commonly desired by fielders. It is also recognized that while the foregoing describes device 10 with specific reference to forming, shaping and protecting a glove 100, device 10 can also be suitably shaped and configured to form, shape and protect and type of shapeable object 100 in alternative embodiments of the present invention.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A glove forming device configured for shaping into a desired shape a baseball or softball glove having a web portion with an exterior and an interior, said device comprising:

an exterior wall conforming to said exterior of said glove;

an interior wall conforming to said interior of said glove, wherein said interior wall is spaced apart from said exterior wall;

a top wall connecting said exterior wall and said interior wall along an upper end of said device; and a void defined between said exterior wall and said interior wall;

wherein said void is configured to receive said web of said glove within said device, form said glove into said desired shape and maintain said glove in said desired shape while positioned within said void;

wherein said interior wall includes an upper region extending vertically in the longitudinal direction and a lower region extending inward from said upper region at an angle to define a pocket forming region in said device, wherein said pocket forming region is configured to form a pocket into said interior of said glove;

wherein said exterior wall has an overall height greater than an overall height of said interior wall and said exterior wall extends beyond said interior wall in the longitudinal direction.

2. The device of claim 1, further comprising an opening defined between a terminal edge of said exterior wall and a terminal edge of said interior wall, wherein said opening is configured to allow said glove to be inserted into said void.

3. The device of claim 2, wherein said opening includes a cutout defined in a lower portion of said exterior.

4. The device of claim 1, wherein said exterior wall and said interior wall have an arcuate horizontal cross-section extending in the lateral direction configured to generally conform to said web portion of said glove.

5. The device of claim 1, wherein said device is configured into a rigid shape.

6. The device of claim 1, further comprising a strap connected to said exterior wall.

7. A glove forming device configured for forming and shaping a baseball or softball glove into a desired shape, wherein said glove includes a web with an exterior web sidewall and an interior web sidewall, said device comprising:

an exterior wall conforming to said exterior web sidewall of said glove when said glove is placed in said desired shape;

an interior wall conforming to said interior web sidewall of said glove when said glove is placed in said desired shape;

a top wall extending between said exterior wall and said interior wall and connecting said exterior wall and interior wall;

a void defined between said exterior wall and said interior wall, wherein said exterior wall is spaced apart from said interior wall by a distance approximately equal or greater than a thickness of said web of said glove along at least a portion of a height of said device; and an opening defined by one or more edges of said exterior wall and one or more edges of said interior wall, said opening configured for providing access to said void and allowing said glove to be at least partially inserted into said device;

wherein said void is configured for receiving said glove and holding said glove between said exterior wall and said interior wall, wherein said exterior wall and said interior wall are configured to maintain said glove in said desired shape while said glove is received within said void;

wherein said interior wall includes a pocket forming region shaped to form a pocket region into said interior web sidewall of said glove;

wherein said exterior wall has an overall height greater than an overall height of said interior wall and said exterior wall extends beyond said interior wall in the longitudinal direction.

8. The device of claim 7, wherein said exterior wall comprises a first exterior portion and a second exterior portion, wherein said second exterior portion has an arcuate shape that generally conforms to a curvature of a hand receiving region of said glove, and wherein said second exterior portion curves inward with respect to said first exterior portion.

9. The device of claim 8, wherein said interior wall comprises a first interior portion and a second interior portion, wherein said first interior portion conforms to said first exterior portion, and wherein said second interior portion curves inward with respect to said first interior portion.

10. The device of claim 9, wherein said void comprises a first void portion defined between said first exterior portion and said first interior portion and a second void portion defined between said second exterior portion and said second interior portion, wherein a width of said second void portion is greater than a width of said first void portion.

11. The device of claim 10, wherein said first interior portion is angled inward with respect to said first exterior portion so that said first void portion gradually increases in width at it approaches said second void portion.

12. The device of claim 7, wherein said exterior wall includes a lower edge defining a cutout within said opening.

13. The device of claim 7, wherein device has a rigid shape configured to prevent said glove from changing shape when said glove is inserted into said void of said device.

14. A glove forming device configured for shaping into a desired shape a baseball or softball glove having a web portion with an exterior and an interior, said device comprising:

an exterior wall conforming to said exterior of said glove;

an interior wall conforming to said interior of said glove, wherein said interior wall is spaced apart from said exterior wall;

a top wall connecting said exterior wall and said interior wall along an upper end of said device; and a void defined between said exterior wall and said interior wall;

wherein said void is configured to receive said web of said glove within said device, form said glove into said desired shape and maintain said glove in said desired shape while positioned within said void;

wherein said exterior wall includes an upper region extending vertically in the longitudinal direction and a lower region extending inward from said upper region at an angle;

wherein said exterior wall has an overall height greater than an overall height of said interior wall and said exterior wall extends beyond said interior wall in the longitudinal direction.

15. The device of claim 14, further comprising an opening defined between a terminal edge of said exterior wall and a terminal edge of said interior wall, wherein said opening is configured to allow said glove to be inserted into said void.

16. The device of claim 15, wherein said opening includes a cutout defined in a lower portion of said exterior.

17. The device of claim 14, wherein said void has a first width between said lower regions of said exterior and interior walls and a second width between said upper regions of said exterior and interior walls, wherein said first width is greater than said second width.

18. The device of claim 14, wherein said exterior wall and said interior wall have an arcuate horizontal cross-section extending in the lateral direction configured to generally conform to said web portion of said glove.

19. The device of claim 14, wherein said device is configured into a rigid shape.

20. The device of claim 14, further comprising a strap connected to said exterior wall.

* * * * *